US007231794B2

(12) United States Patent
Kidowaki

(10) Patent No.: US 7,231,794 B2
(45) Date of Patent: Jun. 19, 2007

(54) METHOD FOR MANUFACTURING A WORM SHAFT

(75) Inventor: Koji Kidowaki, Toyohashi (JP)

(73) Assignee: ASMO Co., Ltd., Shizuoka-pref. (JP)

( * ) Notice: Subject to any disclaimer, the term of this patent is extended or adjusted under 35 U.S.C. 154(b) by 182 days.

(21) Appl. No.: 11/012,188

(22) Filed: Dec. 16, 2004

(65) Prior Publication Data

US 2005/0138980 A1 Jun. 30, 2005

(30) Foreign Application Priority Data

Dec. 26, 2003 (JP) ..... 2003-432347

(51) Int. Cl.
*B21D 17/04* (2006.01)
*B21H 3/12* (2006.01)

(52) U.S. Cl. ..... 72/88

(58) Field of Classification Search ..... 72/88, 72/90, 469

See application file for complete search history.

(56) References Cited

U.S. PATENT DOCUMENTS 3,803,889 A * 4/1974 Muenchinger ..... 72/88
3,875,780 A * 4/1975 Cochrum et al. ..... 72/90
4,724,694 A * 2/1988 Medal ..... 72/88
6,135,892 A * 10/2000 Donovan ..... 470/10

FOREIGN PATENT DOCUMENTS

JP A-2003-145242 5/2003

* cited by examiner

*Primary Examiner*—Daniel C. Crane
(74) *Attorney, Agent, or Firm*—Posz Law Group, PLC

(57) ABSTRACT

An object of the present invention is to provide a method of manufacturing a rotational shaft having a worm, wherein a worm portion has a small bending amount. According to the method of the invention, a worm portion is formed at a worm forming portion by a rolling process with rolling dies, and a small diameter portion is formed at least at one axial end of the worm forming portion, wherein a diameter of the small diameter portion is smaller than a diameter of a bottom of a worm tooth to be formed at the worm forming portion, so that surplus material portion of the worm forming portion can flow toward the small diameter portion.

4 Claims, 5 Drawing Sheets

FIG. 2A
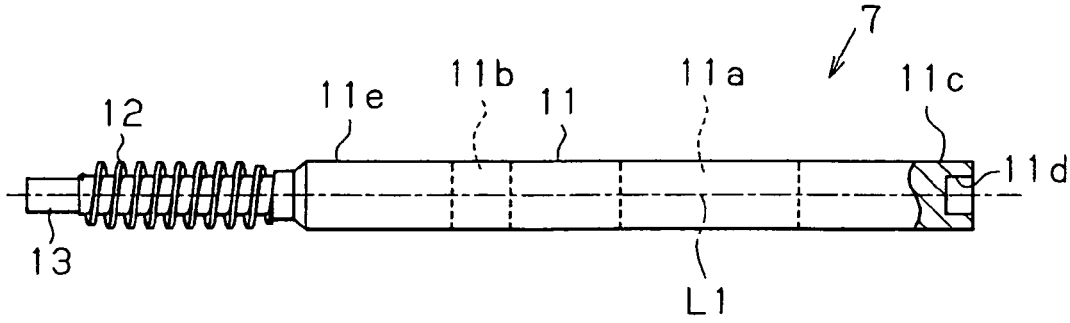
FIG. 2B
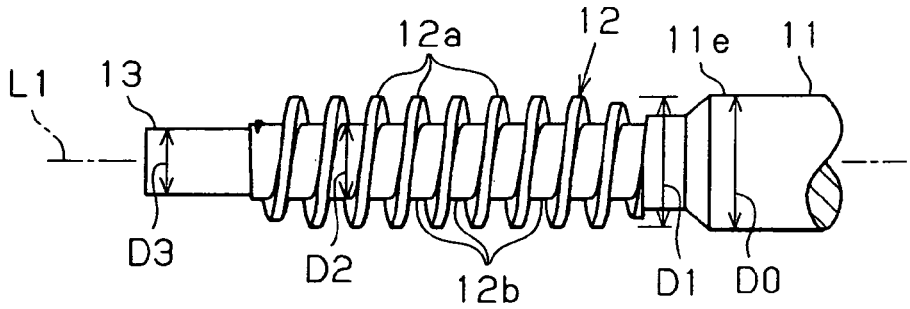
FIG. 3A
FIG. 3B
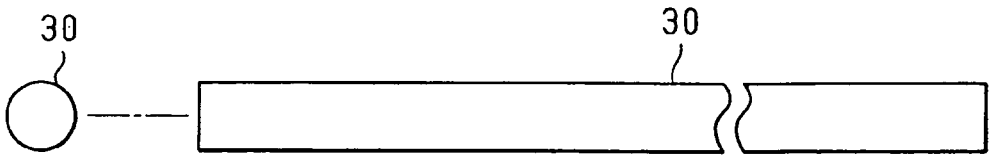

METHOD FOR MANUFACTURING A WORM SHAFT

CROSS REFERENCE TO RELATED APPLICATION

This application is based on Japanese Patent Application No. 2003-432347 filed on Dec. 26, 2003, the disclosure of which is incorporated herein by reference.

FIELD OF THE INVENTION

The present invention relates to a worm shaft to be used for a rotor of an electric rotating machine, and particularly to a method for manufacturing the same.

BACKGROUND OF THE INVENTION

A rotational shaft having a worm is manufactured by a rolling process with rolling dies. Namely, a rod material is pressed by and between a pair of rolling dies, and the rolling dies are moved relative to and in parallel to each other, so that the rod material is rotated between the rolling dies, to finally form the worm on an outer surface of the rod material.

It is, however, known in the art that a bending portion is likely formed at an end of the worm portion (a charged-up portion of a worm tooth (an incomplete worm tooth)), or the worm shaft is likely bent, due to a large bending moment to be generated at an end portion of the rolling dies during the rolling process.

When the worm shaft having such a bending portion is used in a product, for example, for an electric rotating machine, it may cause abnormal vibrations or noises with its rotation.

Accordingly, an adjusting process is generally necessary to adjust such a bending of the worm shaft after the rolling process. And therefore, a manufacturing process is inevitably long and a higher manufacturing cost is unavoidable.

Japanese Patent Publication No. 2003-145242 discloses a method of manufacturing a worm shaft, in which an adjusting portion is formed next to a worm portion. The worm portion is formed by a rolling process with a pair of rolling dies, and the adjusting portion is reformed by another pair of reforming dies arranged next to the rolling dies, so that a possible bending of the worm shaft is reformed to become a straight shaft by the reforming dies at the same time during which the worm portion is formed by the rolling dies.

During the rolling process, a surplus material, which is surplus material for forming worm teeth, is likely to flow toward axial ends of the worm shaft. If such surplus material were not escaped from a worm forming portion to the axial ends of the worm shaft, it may cause a stress at the worm portion to finally result in the bending of the worm portion.

In the above mentioned technology disclosed in the above Japanese Patent Publication, the possible bending of the worm shaft is reformed by the reforming dies. It does not, however, suggest a method of manufacturing a worm shaft, without such an additional adjusting process, having a small bending at the worm portion, in view of flowing (escaping) the surplus material to the axial ends of the worm portion during the rolling process.

SUMMARY OF THE INVENTION

It is, therefore, an object of the present invention, in view of the above mentioned problems, to provide a manufacturing method of a rotational shaft having a worm, according to which a bending of the worm shaft may not be easily generated during the rolling process.

According to a feature of the present invention, a worm is formed at a worm forming portion by a rolling process with rolling dies, and a small diameter portion is formed in at least one axial end of the worm forming portion. A diameter of the small diameter portion is made smaller than a diameter of the bottom of a worm tooth to be formed at the worm forming portion, so that surplus material portion of the worm forming portion can flow toward the small diameter portion. Since the small diameter portion (forward end) is not working as a resistance against the material flow, the surplus material smoothly flows toward the forward end, wherein the surplus material is twistingly wound at the forward end. As a result, a possible stress to the rod material including the worm forming portion is small, so that the armature shaft having a small bending at the worm portion can be manufactured.

According to another feature of the present invention, the bottom of the worm tooth has a longitudinally flat surface, which is in parallel to an axis line of the worm forming portion. This means that a tooth top of the rolling dies has a corresponding flat surface to form the bottom having the flat surface. Since the flat surface of the tooth top supports the bottom of the worm tooth during the rolling process, the axis line of the worm portion is kept and a misalignment of the axis line can be avoided. And thereby, a possible bending of the worm shaft can be also suppressed to a minimum amount.

According to a further feature of the present invention, the diameter of the bottom is made larger than the diameter of the small diameter portion by at least 0.1 mm. According to the above dimensional feature, a burr is prevented from forming at the end of the worm to which the surplus material escaped from the worm forming portion, so that a possible bending of the worm due to the burr can be further can be avoided.

According to a further feature of the present invention, a ratio of a difference (between a diameter of a worm bottom D2 and a diameter of a forward end D3) to the diameter D2 of the bottom 12*b* is made to be between 1.5% and 15%.

BRIEF DESCRIPTION OF THE DRAWINGS

The above and other objects, features and advantages of the present invention will become more apparent from the following detailed description made with reference to the accompanying drawings. In the drawings:

FIG. 2A is a plan view showing the armature shaft;

FIG. 2B is an enlarged plan view showing a worm portion of the armature shaft;

FIG. 3A is a side view showing a rod material for the armature shaft;

FIG. 3B is a plan view showing the rod material;

DETAILED DESCRIPTION OF THE PREFERRED EMBODIMENTS

Figure 1:
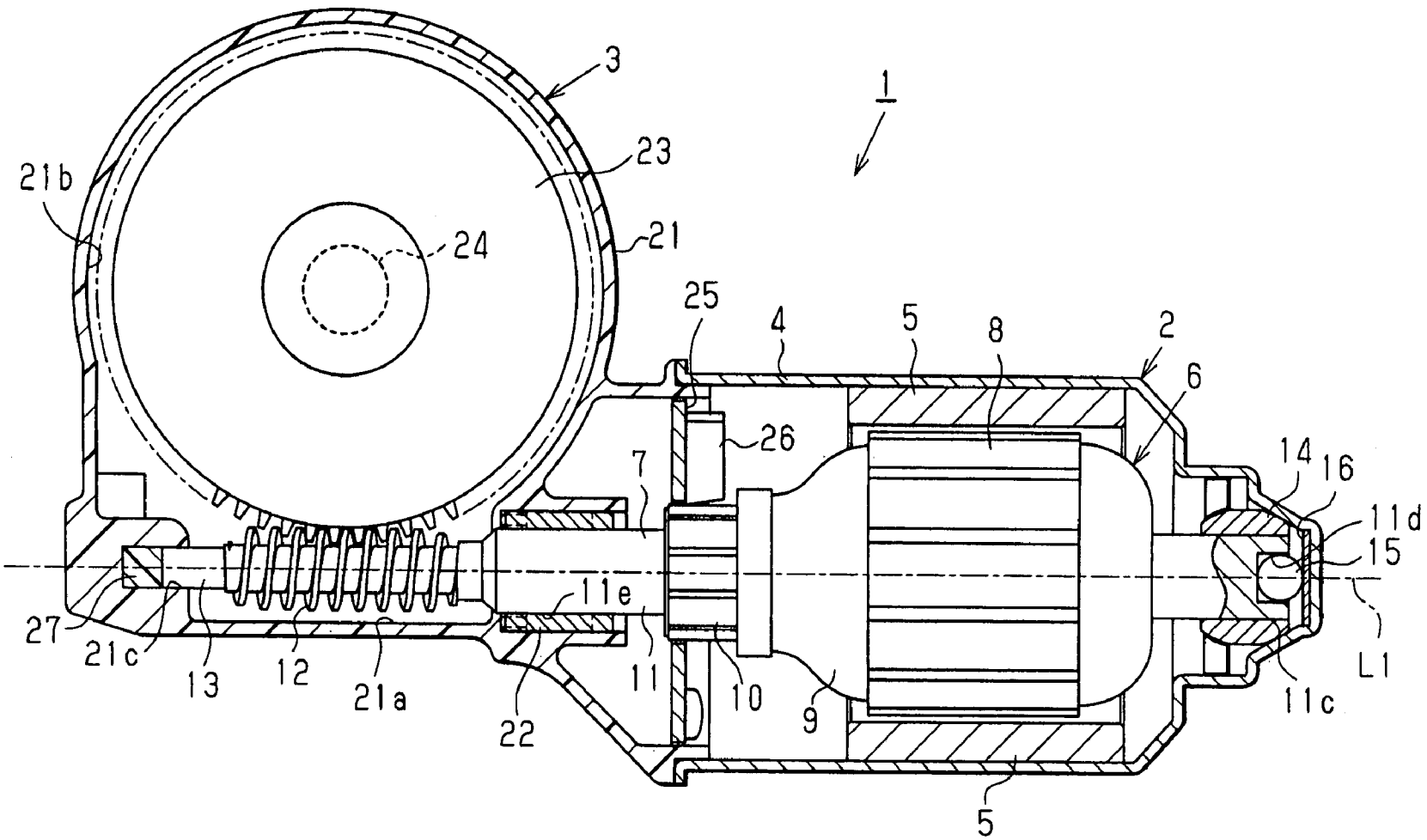
FIG. 1 is a cross sectional view showing an electric motor having an armature shaft according to the present invention.

An embodiment of the present invention will be now explained with reference to the drawings. In FIG. 1, a numeral 1 designates an electric motor, which is used as a driving source for a wiper system of an automotive vehicle, and which comprises a motor portion 2 and a speed reduction portion 3, in which a speed reduction device is housed, and which is integrally formed with the motor portion 2.

The motor portion comprises a direct current motor and a cylindrical yoke housing 4 with a closed end (bottom portion). A pair of magnets 5 is fixed to an inner surface of the yoke housing 4, and an armature 6 is rotationally housed in an inside space formed by the yoke housing 4 and the magnets 5. The armature 6 comprises an armature shaft 7, a core 8, a winding 9 and a commutator 10.

The armature shaft 7 comprises a main shaft portion 11 having a predetermined length from a rear end 11*c*, a worm portion 12 and a forward end 13, as shown in FIGS. 2A and 2B.

An almost middle portion 11*a* of the main shaft portion 11 is a core fixing portion, to which the core 8 is fixed, and a portion 11*b* between the worm portion 12 and the core fixing portion 11*a* is a commutator fixing portion to which the commutator 10 is fixed. The rear end 11*c* of the armature shaft 7 is supported by a slide bearing 14, which is firmly held by the bottom portion of the yoke housing 4 at its center, as shown in FIG. 1. And a recess portion 11*d* having a U-shaped cross section is formed at the rear end 11*c*, in which a steel ball 15 is accommodated so that the steel ball 15 receives a thrust force of the armature shaft 7. A portion of the steel ball 15 projects out of the recess 11*d*. A connecting portion 11*e* between the main shaft portion 11 and the worm portion 12 is a middle shaft supporting portion, which is rotationally supported by a slide bearing 22 firmly fixed to a gear housing 21 of the speed reduction portion 3.

The worm portion 12 is formed on a shaft portion between the middle shaft supporting portion 11*e* and the forward end 13, as shown in FIG. 2B. An outer diameter D1 of the worm portion 12 (a diameter of a tooth top of a worm tooth 12*a* forming the worm portion 12) is made smaller than a diameter D0 of the middle shaft supporting portion 11*e*, so that the worm portion 12 can be inserted into the gear housing 21 through the slide bearing 22. A bottom 12*b* of the worm tooth 12*a* is formed into a cylindrical shape, so that a surface of the bottom 12*b* in an axial direction is in parallel to an axis line L1 of the armature shaft 7. An axial length of the bottom 12*b* in the direction of the axis line L1 is made slightly larger than an axial length (width) of the worm tooth 12*a*. A diameter D2 of the bottom 12*b* of the worm tooth 12*a* is made larger than a diameter D3 of the forward end 13. In the embodiment, the diameter D2 of the bottom 12*b* is made larger, by 0.1–1.0 mm, than the diameter D3.

The core 8 is fixed to the core fixing portion 11*a* of the armature shaft 7, and the commutator 10 is fixed to the commutator fixing portion 11*b*. The winding 9 is wound in the core 8 and connected to the commutator 10, to form the armature 6. The armature 6 is housed in the yoke housing 4, in which the magnets 5 are fixed to the inner surface of the yoke housing 4. The rear end 11*c* is inserted into the slide bearing 14, so that the steel ball 15 is accommodated in the recess 11*d* and the steel ball 15 comes in contact with a thrust plate 16 fixed to the bottom end of the yoke housing 4. Then, the yoke housing 4 (the motor portion) having the armature 6 is assembled to the gear housing 21 (the speed reduction portion 3).

The gear housing 21 comprises a shaft accommodating portion 21*a* for accommodating the worm portion 12 of the armature shaft 7, and a wheel accommodating portion 21*b* for accommodating a worm wheel 23.

The slide bearing 22 is fixed to one end of the shaft accommodating portion 21*a*, at which the connecting portion 11*e* of the armature shaft 7 is rotationally supported. An insertion hole 21*c* is formed at the other end of the shaft accommodating portion 21*a* (opposite side of the motor portion), into which the forward end 13 of the armature shaft 7 is inserted. Since the insertion hole 21*c* functions as a bearing, the forward end 13 of the armature shaft 7 is also rotationally supported by the hole 21*c*. A resin material 27 is filled into the bottom of the insertion hole 21*c* and cured therein, so that a thrust clearance is adjusted to prevent a bumping movement of the armature shaft 7 in the axial direction.

The worm wheel 23, which is engaged with the worm portion 12 of the armature shaft 7, is rotationally housed in the wheel accommodating portion 21*b*. An output shaft 24 is integrally formed to the worm wheel 23.

A brush device 25 is fixed to an end wall of the motor portion 2, which is located between the yoke housing 4 and the gear housing 21. Multiple brushes are held in the brush device 25, and the brushes are in a sliding contact with the commutator 10, to supply electric power from an outside electric power source (not shown) to the armature 6 (the winding 9) through the commutator 10. The armature 6 is thereby rotated and its rotational force is transmitted to the output shaft 24 through the armature shaft 7, the worm portion 12 and the worm wheel 23. And finally the wiper system is operated by the rotation of the output shaft 24 through a wiper link mechanism.

A process for manufacturing the armature shaft 7 having the worm will be explained.

Figure 4:
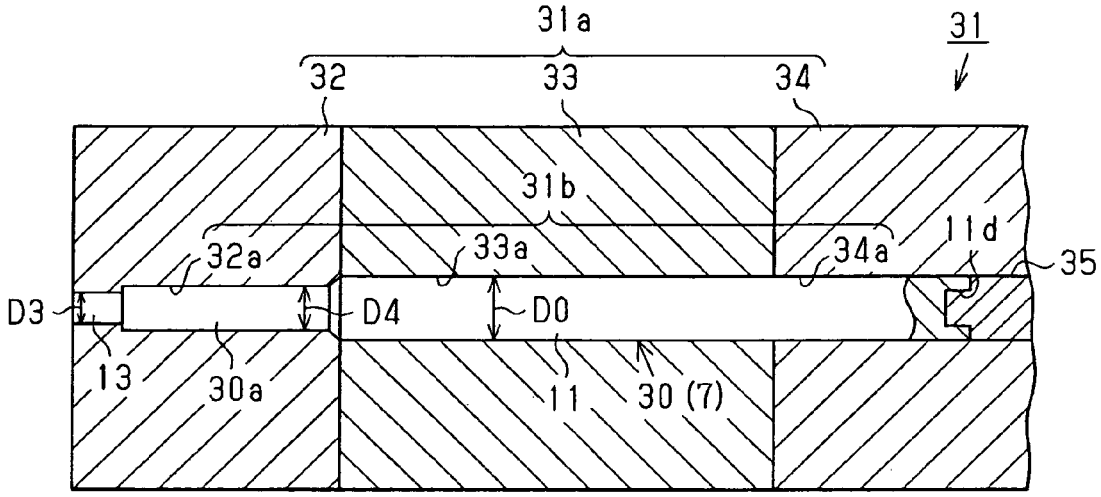
FIG. 4 is a schematic cross sectional view showing a process for manufacturing the armature shaft.

The armature shaft 7 is manufactured from a rod material 30 shown in FIGS. 3A and 3B. The rod material 30 is, at first, processed by a cold forging with forging dies, as shown in FIG. 4.

The forging dies 31 comprises a main die portion 31*a* having three divided dies 32, 33 and 34 which are divided in a direction of an axis line of the rod material 30, and a slide die 35 which will be press inserted into the die 34. A shaft forming recess 31*b* for processing the shaft 7 is formed in the dies 32 to 34.

The first die 32 has a recess 32*a* for forging a forward end portion of the rod material 30, to form the forward end 13 and a worm forming portion 30*a*. The second and third dies 33 and 34 have recesses 33*a* and 34*a* for firmly supporting the rod material 30 during the forging process for the forward end 13 and the worm forming portion 30*a* by the first die 32. The slide die 35 forms the recess lid at the rear end of the rod material 30.

A diameter D4 of the worm forming portion 30*a* is made to be smaller than the diameter D0 of the main shaft portion 11, but larger than the diameter D3 of the forward end 13. The diameter D4 of the worm forming portion 30*a* is slightly larger than the diameter D2 of the bottom 12*b* of the worm portion 12, as shown in FIG. 2B, which will be afterward processed.

Figure 5:
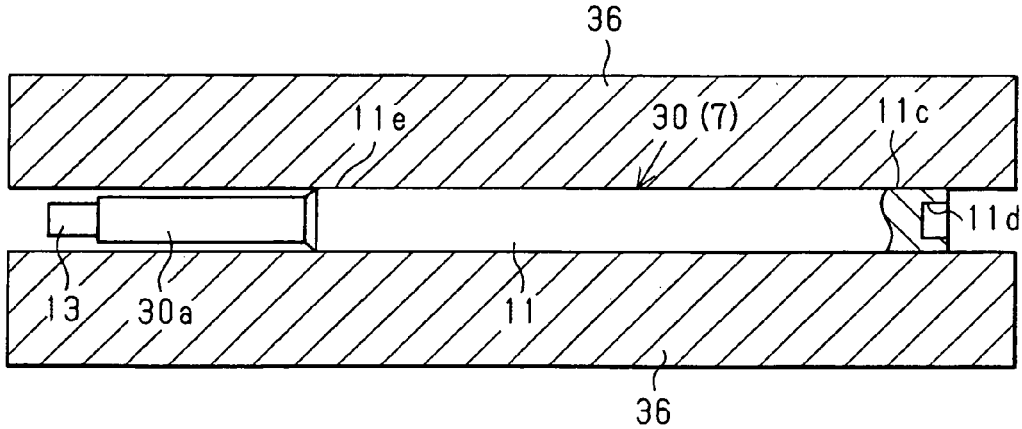
FIG. 5 is a schematic cross sectional view showing another process for manufacturing the armature shaft.

Then, the entire outer peripheral surface of the main shaft portion 11 is processed by grinding with grinding stones 36, as shown in FIG. 5, in order that the outer peripheral surfaces of the rear end 11*c* and the connecting portion 11*e* are formed with a higher accuracy. As a result, surface roughness at the rear end 11*c* and the connecting portion 11*e* is enhanced.

Figure 6A:
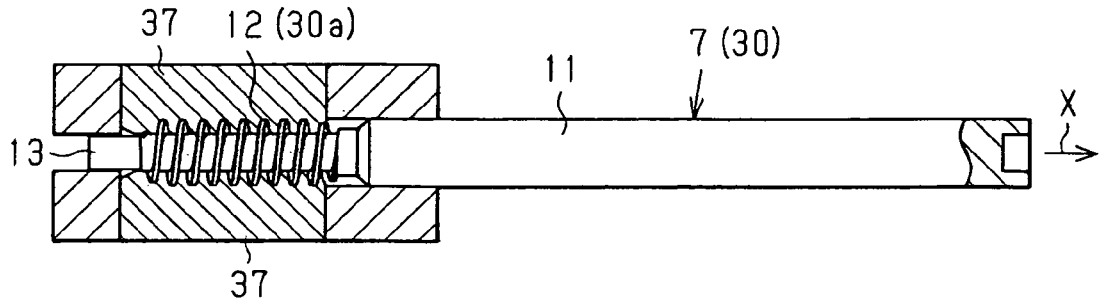
FIG. 6A is a further schematic cross sectional view showing the process for manufacturing the armature shaft.
Figure 6B:
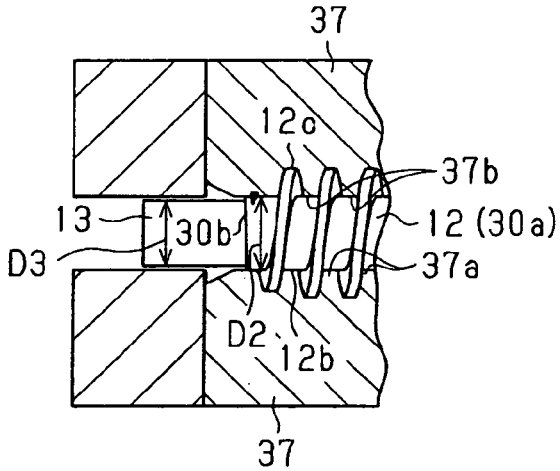
FIG. 6B is an enlarged cross sectional view showing the worm portion of FIG. 6A.

Thereafter, the worm forming portion 30*a* is processed by a rolling process to form the worm portion 12, as shown in FIG. 6A. The worm forming portion 30*a* is interposed between a pair of flat rolling dies 37, and the flat rolling dies 37 are moved in parallel and relative to each other, while the worm forming portion 30*a* is pressed by the flat rolling dies 37. The worm forming portion 30*a* is thereby rotated between the rolling dies 37 to finally form the worm portion 12 on that portion 30*a*. During the above rolling process, a part of material around a portion forming the bottom 12*b* is charged up to a neighboring portion to form a tooth top 12*c*, as shown in FIG. 6B. Furthermore, the rolling dies 37 are so designed that the main shaft portion 11 (the rod material 30) can be rotated and moved in a direction X in FIG. 6A away from the rolling dies 37, during the rolling process. According to the movement, a surplus material 30*b* of the worm forming portion 30*a* is extended to flow toward the forward end 13 opposite to the direction X of the movement. Since the diameter D3 of the forward end 13 is made smaller than the diameter D2 of the bottom 12*b*, the forward end 13 is not working as a resistance against the material flow, so that the surplus material smoothly flows toward the forward end 13, wherein the surplus material 30*b* is twistingly wound at the forward end 13. As a result, a possible stress to the rod material 30 including the worm forming portion 30*a* is small, so that the armature shaft 7 having a small bending at the worm portion 12 can be manufactured.

As already explained, the surface of the bottom 12*b* is made in parallel to the axis line L1 of the armature shaft 7. In other words, a forward end surface 37*b* of a screw head 37*a* of the rolling dies 37, which forms the bottom 12*b* of the worm portion 12, is in parallel to the axis line L1. Since the forward end surface 37*b* supports the bottom 12*b* of the worm portion 12 during the rolling process, the axis line of the worm portion 12 is kept and a misalignment of the axis line can be avoided. And thereby, a possible bending of the worm portion 12 can be also suppressed to a smaller amount.

As is also explained above, the diameter D4 of the worm forming portion 30*a* as well as the diameter D3 of the forward end 13 is so made that the surplus material 30*b* at the worm forming portion 30*a* is twistingly wound on the forward end 13 in its circumferential direction by almost one turn. Accordingly, a pressing force is applied by the rolling dies 37 to the worm forming portion 30*a*, in a manner that the surplus material 30*b* may be impartially extended over the entire circumferential portion of the forward end 13. And thereby, the axis line of the worm portion 12 is also kept, a misalignment of the axis line of the worm portion 12 can be further suppressed, and a possible bending of the worm portion 12 can be further suppressed to a smaller amount.

Furthermore, in the embodiment explained above, the diameter D2 of the bottom 12*b*, after the worm portion 12 has been formed, is made larger than the diameter D3 of the forward end 13 by a range of 0.1 to 1.0 mm. The lower limit of the range is made larger than 0.1 mm, namely the diameter D2 is made larger than the diameter D3 by at least 0.1 mm. This is because that the surplus material 30*b* escaped from the worm forming portion 30*a* may become burr, when the diameter D2 is smaller and a difference between the diameters D2 and D3 becomes smaller than the lower limit (0.1 mm).

In the embodiment, a width of the rolling dies 37, a length of the worm forming portion 30*a*, an amount of the movement of the rod material during the rolling process, and so on are totally considered, so that the above effects can be obtained at most.

Figure 7:
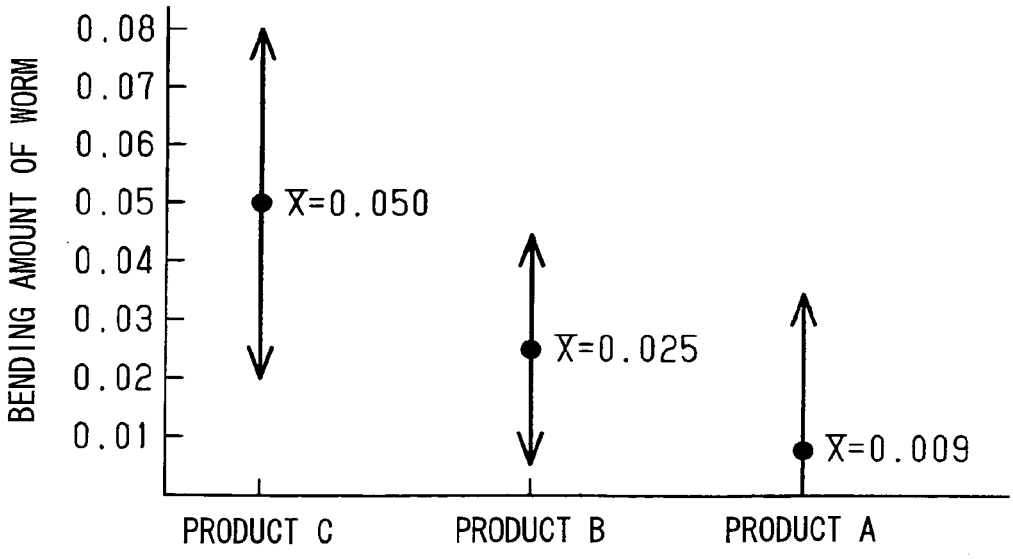
FIG. 7 is a distribution map showing fluctuation of the bending of the worm shaft according to the different manufacturing processes.

For example, FIG. 7 shows a bending amount of the worm portion 12 according to three different manufacturing processes.

In FIG. 7, the products "A" show a range of fluctuation for the bending amount, in which the products "A" are manufactured by the process according to the present invention. Namely, the diameter D2 of the bottom 12*b* is made larger than the diameter D3 of the forward end 13 by 0.1 to 1.0 mm, and the surface of the bottom 12*b* is made flat in parallel to the axis line L1 of the rod material 30.

The products "B" show a range of fluctuation for the bending amount, in which the products "B" are manufactured by the process, in which the diameter D2 of the bottom 12*b* is made larger than the diameter D3 of the forward end 13 by 0.1 to 1.0 mm, but the surface of the bottom 12*b* is not made flat in parallel to the axis line L1 of the rod material 30.

The products "C" show a range of fluctuation for the bending amount, in which the products "C" are manufactured by the process, in which the diameter D2 of the bottom 12*b* is made larger than the diameter D3 of the forward end 13, but a difference between those diameters is less than 0.1 mm, and furthermore the surface of the bottom 12*b* is not made flat in parallel to the axis line L1 of the rod material 30.

As apparent from FIG. 7, the range of fluctuation for the bending amount of the worm portion 12, according to the products "A", is the smallest and its center value is also at the smallest value.

Figure 8:
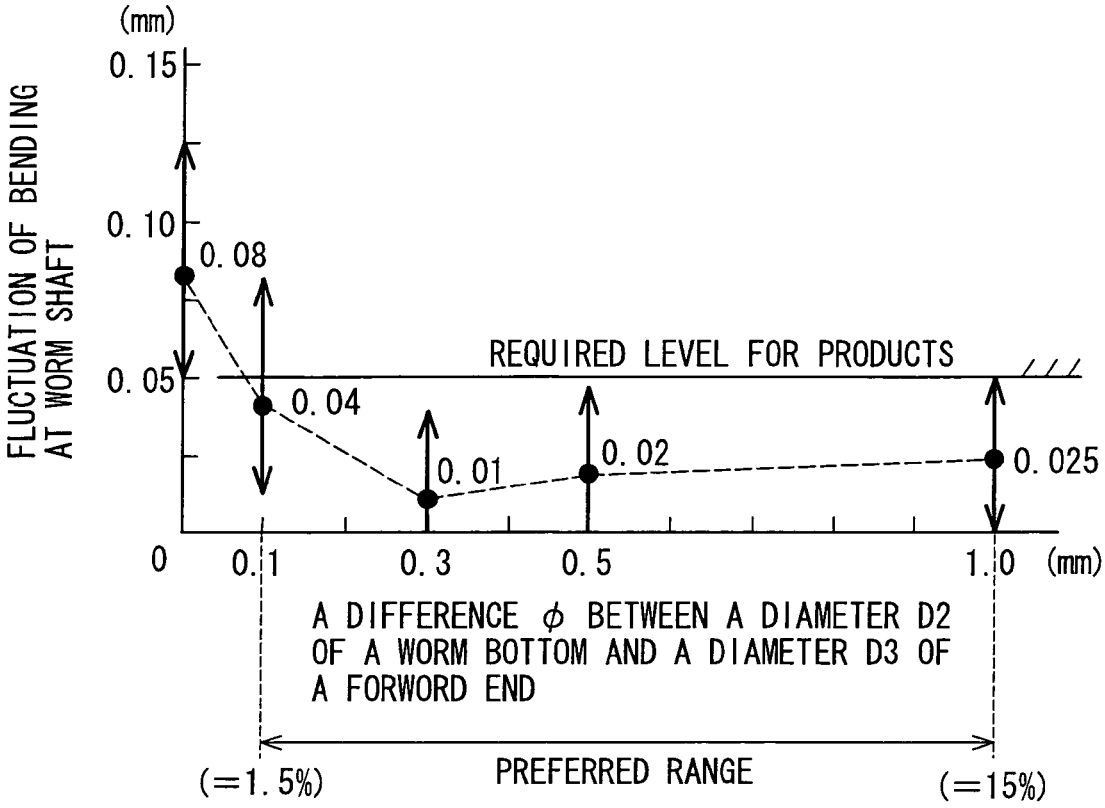
FIG. 8 is also a distribution map showing fluctuation of the bending of the worm shaft, wherein a difference of a diameter of a worm bottom and a diameter of a forward end of a worm.

FIG. 8 further shows a bending amount of the worm portion 12 of the products A, in which a difference between the diameter D2 of the bottom 12*b* and the diameter D3 of the forward end 13 is varied between 0.1 and 1.0 mm. The above differences of 0.1 mm and 1.0 mm respectively correspond to a ratio of 1.5% and a ratio of 15%, wherein the ratio means a ratio of the difference (between D2 and D3) to the diameter D2 of the bottom 12*b*.

As is also apparent from FIG. 8, the fluctuation of the bending amount of the worm portion 12 is within a range of a required level for the products, when the difference of the diameters D2 and D3 is in a range between 0.1 and 1.0 mm, or in a range of the ratio between 1.5% and 15%.

The difference of the diameters between D2 and D3 of 1.0 mm, or the ratio of 15% is almost an upper limit in view of the cold forging process, and the difference of 0.1 mm, or the ratio of 1.5% is a lower limit in view of generating the burr.

As explained above, the armature shaft 7 having a small bending amount at its worm portion 12 is obtained according to the present invention. As a result, a rotational stability of the armature shaft 7 is enhanced, and thereby a rotational stability of the armature 6 can be improved. Furthermore, an engagement efficiency between the worm portion 12 and the worm wheel 23 is increased, and noises generated by the engagement between the worm and the worm wheel can be reduced, so that the electric motor having a higher efficiency and lower noise can be obtained.

Since the armature shaft having a small bending amount at the worm portion can be obtained without any adjusting processes and adjusting apparatuses, the manufacturing cost can be reduced.

The above embodiment can be modified in various ways as below.

A small diameter portion is formed at the forward end 13 of the worm forming portion 30*a* in the above embodiment. However, the small diameter portion can be formed on the opposite end of the worm forming portion 30*a*, namely between the worm forming portion 30*a* and the connecting portion 11*e*. Furthermore, the small diameter portions can be formed at both ends of the worm forming portion 30*a*.

The surface of the bottom 12*b* is not limited to the flat surface. The bottom 12*b* can be formed into a V-shape.

The shaft formed with the worm according to the present invention may not be limited to the armature shaft of the motor. The present invention can be applied to any other shafts formed with the worm.

The worm forming portion 30*a* and the forward end 13 can be formed not only by the cold forging process in the above embodiment, but also by any other processes, such as a cutting process.

The rolling dies 37 are not limited to the flat rolling dies.

What is claimed is:

1. In a worm gear apparatus that includes a housing: a worm wheel rotatably supported in and by the housing, and a worm shaft rotatably supported in and by the housing and engaged with the worm wheel, to transmit a rotational force of the worm shaft to the worm wheel, the worm shaft having a worm portion to be engaged with the worm wheel, a small diameter shaft portion formed at a forward end rotatably supported by the housing, and a large diameter shaft portion at the opposite side of the worm portion, a method of manufacturing the worm shaft comprising:

a step of preparing a rod material having a worm forming portion;

a step of forming the small diameter shaft portion at least at one axial end of the worm forming portion, wherein a diameter of the small diameter shaft portion is smaller than a diameter of a bottom of a worm tooth to be formed at the worm forming portion; and a step of forming the worm portion at the worm forming portion by a rolling process with rolling dies, wherein the worm forming portion is rotated and moved in a direction away from the rolling dies during the rolling process, and a surplus material portion of the worm forming portion is extended in a direction opposite to the moving direction of the worm forming portion, so that the surplus material portion flows toward the small diameter shaft portion.

2. A method of manufacturing the worm shaft according to claim 1, further comprising forming the bottom to have a longitudinally flat surface, which is parallel to an axis line of the worm forming portion.

3. A method of manufacturing the worm shaft according to claim 1, wherein the diameter of the bottom is made larger than the diameter of the small diameter shaft portion by at least 0.1 mm.

4. A method of manufacturing a rotational shaft having a worm comprising:

a step of preparing a rod material having a worm forming portion; a step of forming a small diameter portion at least at one axial end of the worm forming portion, wherein a diameter of the small diameter portion is smaller than a diameter of bottom of a worm tooth to be formed at the worm forming portion, and wherein a ratio of a difference between the diameter of the bottom and the diameter of the small diameter portion to the diameter of the bottom is between 1.5% and 15%; and a step of forming a worm portion at the worm forming portion by a rolling process with rolling dies, wherein surplus material portion of the worm forming portion can flow toward the small diameter portion.

* * * * *